US005858021A

United States Patent [19]

Sun et al.

[11] Patent Number: 5,858,021

[45] Date of Patent: Jan. 12, 1999

[54] TREATMENT PROCESS FOR CELLULOSIC FIBERS

[75] Inventors: Tong Sun; Yong De Yao, both of Neenah; Sheng-Hsin Hu, Appleton, all of Wis.

[73] Assignee: Kimberly-Clark Worldwide, Inc., Neenah, Wis.

[21] Appl. No.: 939,099

[22] Filed: Sep. 26, 1997

Related U.S. Application Data

[60] Provisional application No. 60/029,343, Oct. 31, 1996.

[51] Int. Cl.[6] ..... D06M 11/38

[52] U.S. Cl. ..... 8/125; 8/115.51; 162/90; 162/91; 162/100; 162/109; 162/111; 162/188; 162/197

[58] Field of Search ..... 8/125, 115.51; 162/90, 91, 100, 109, 111, 188, 197

[56] References Cited

U.S. PATENT DOCUMENTS

| | | | |
|---|---|---|---|
| 1,857,100 | 5/1932 | McCormick et al. | 162/100 |
| 3,521,638 | 7/1970 | Parrish | 128/284 |
| 3,525,735 | 8/1970 | Miller | 260/231 |
| 3,769,152 | 10/1973 | Samuelson et al. | 162/65 |
| 3,971,379 | 7/1976 | Chatterjee | 128/285 |
| 4,075,279 | 2/1978 | Holst et al. | 536/88 |
| 4,165,743 | 8/1979 | Denning | 128/290 R |
| 4,399,275 | 8/1983 | Sears | 536/70 |
| 4,710,187 | 12/1987 | Boland et al. | 604/385 A |
| 4,762,521 | 8/1988 | Roessler et al. | 604/38 SA |
| 4,770,656 | 9/1988 | Proxmire et al. | 604/393 |
| 4,798,603 | 1/1989 | Meyer et al. | 604/378 |
| 4,898,642 | 2/1990 | Moore et al. | 162/157.6 |
| 4,908,097 | 3/1990 | Box | 162/9 |
| 4,986,882 | 1/1991 | Mackeye t al. | 162/109 |
| 5,149,335 | 9/1992 | Kellenberger et al. | 604/372 |
| 5,183,707 | 2/1993 | Herron et al. | 428/364 |
| 5,247,072 | 9/1993 | Ning et al. | 536/97 |
| 5,318,554 | 6/1994 | Young et al. | 604/378 |
| 5,464,547 | 11/1995 | Stehlin et al. . | |

FOREIGN PATENT DOCUMENTS

| | | |
|---|---|---|
| 0 429 112 B1 | 5/1991 | European Pat. Off. . |
| 675363 | 2/1930 | France . |
| WO 95/20066 A1 | 7/1995 | WIPO . |

OTHER PUBLICATIONS

American Society for Testing Materials (ASTM) Designation: D 1921–89, "Standard Test Methods for Particle Size (Sieve Analysis) of Plastic materials," pp. 493–496, published Aug. 1989.

TAPPI Official Test Method T 203 om–93, "Alpha–, Beta–, and Gamma–Cellulose in Pulp," published by the TAPPI Press, Atlanta, Georgia, revised 1993, pp. 1–4. (Month unknown).

TAPPI Official Test Method T 401 om–93, "Fiber Analysis of Paper and Paperboard," published by the TAPPI Press, Atlanta, Georgia, revised 1993, pp. 1–13. (Month unknown).

Atalla, R. H. et al., "$_{13}$C NMR Spectra of Cellulose Polymorphs," *Journal of the American Chemical Society: Communications to the Editor*, 102:9, Apr. 1980, pp. 3249–3251.

Corbett, W.M. and J. Kinn, "Some Aspects of Alkali Refining of Pulps," *Tappi*, vol. 41, No. 3, Mar. 1958, pp. 137–144.

Earl, W.L. and D.L. VanderHart, "Observations by High–Resolution Carbon–13 Nuclear Magnetic Resonance of Cellulose I Related to Morphology and Crystal Structure," *Marcromolecules*, vol. 14, No. 3, May–Jun. 1981, pp. 570–574.

Gibbons, G.C., "The Moisture Regain of Methylcellulose and Cellulose Acetate," *The Journal of the Textile Institute*, vol. 44, No. 5, May 1953, pp. T201–T208.

Jeffries, R. et al., "Current Ideas On the Structure of Cotton," *Cellulose Chemistry and Technology*, 3, 1969, pp. 255–274. (Month Unknown).

Kolpak, F.J. and J. Blackwell, "Determination of the Structure of Cellulose II," *Macromolecules*, vol. 9, No. 2, Mar.–Apr. 1976, pp. 273–278.

Kolpak, Francis J., Mark Weih, and John Blackwell, "Mercerization of Cellulose: 1. Determination of the Structure of Mercerized Cotton," *Polymer*, vol. 19, Feb. 1978, pp. 123–131.

Sarko, Anatole, Jeffrey Southwick & Jisuke Hayashi "Packing Analysis of Carbohydrates and Polysaccharides. 7. Crystal Structure of Cellulose III & Its Relationship to Other Cellulose Polymorphs," *Macromolecules*, vol. 9, No. 5, Sep.–Oct. 1976, pp. 857–863.

Stipanovic, Arthur J. and Anatole Sarko, "Packing Analysis of Carbohydrates and Polysaccharides. 6. Molecular and Crystal Structure of Regenerated Cellulose II," *Macromolecules*, vol. 9, No. 5, Sep.–Oct. 1976, pp. 851–857.

Thomas, B.B., "Specialty Papermaking With Mercerized Wood Fibers," *Tappi*, vol. 49, No. 12, Dec. 1966, pp. 515–521.

Valentine, L., "Absolute Crystallinities of Celluloses From Moisture Sorption Determinations," *Chemistry and Industry*, Nov. 3, 1956, pp. 1279–1280.

Warwicker, J.O., "Swelling of Cotton In Alkalis and Acids," *Journal of Applied Polymer Science*, vol. 13, 1969, pp. 41–54. (Month Unknown).

"Bleaching of Chemical Pulps," *Pulp and Paper: Chemistry and Chemical Technology*, 3rd edition, vol. 1, edited by James P. Casey, John Wiley & Sons, New York, 1980, pp. 670–673. (Month Unknown).

(List continued on next page.)

*Primary Examiner*—Alan Diamond
*Attorney, Agent, or Firm*—John R. Schenian

[57] ABSTRACT

Disclosed is a process for treating cellulosic fibers using an alkali metal hydroxide. The process first prepares the cellulosic fibers as a high consistency mixture with water and then adds an alkali metal hydroxide. The high consistency process is quite efficient and has been found to produce cellulosic fibers that are essentially uniformly treated. Also disclosed is a handsheet prepared from the treated cellulosic fibers for use is disposable absorbent products.

17 Claims, No Drawings

OTHER PUBLICATIONS

Derwent World Patent Database Abstract No. 90–204181/27 of JP 2–133,688: Description of Kanzaki Paper Mfg., "Recycling of Waste Thermosensible Recording Paper." (Date Unknown).

Derwent World Patent Database Abstract No. 94–115649/14 of JP 6–065,862: Description of Nisshinbo Ind. Inc., "Highly Water–Absorbent Cellulosic Fibre Production." (Date Unknown).

Derwent World Patent Database Abstract No. 90–124276/16 of US 4,908,097: Description of L. Box, "High–Bulk, Absorbent, Modified Cellulosic Fibres." (Date Unknown).

Derwent World Patent Database Abstract No. 83–813563/45 of SU 988,941: Description of Bondarenko et al., "Processing Waste Newsprint for Manufacture of Toliet Paper." (Date Unknown).

Paperchem Abstract No. 51–11507 of US 4,247,362: Description of J.C. Williams, "High–Yield Fiber Sheets." (Date Unknown).

Paperchem Abstract No. 46–03799 of TAPPI/CPPA Intern. Mech. Pulping Conf., San Francisco, Jun. 16–20, 1975: Description of B. Orgill, "Effect of Chemical Preimpregnation on Thermomechanical Pulping of Hardwoods."

Paperchem Abstract No. 52–03998 of Wood Science Technology 15, No. 1: 31–43, 1981: Description of Casilla et al., "Immersion Technique for studying Wood Wettability." (Month Unknown).

Paperchem Abstract No. 52–01773 of JP Kokai 4,333/80: Description of Shimada et al., "Ethyl Carboxyethyl Cellulose for Enteric Coating." (Date Unknown).

Paperchem Abstract No. 51–06453 of Magyar Textiltech. 33, No. 7:329–340, Jul. 1980: Description of I. Rusznak, "Hot Mercerization (of Cotton)".

Paperchem Abstract No. 51–05247 of GB 1,565,720: Description of ATO Chimie SA, "Process for Improving the Water Wettabilityof Polyolefins." (Date Unknown).

Paperchem Abstract No. 51–04517 of Khim. Drev. (Riga) No. 1: 47–54, Jan./Feb. 1980 (Russ.): Description of Yakobson et al., "Effect of Changes in the Newtork Structure of Lignin–Carbohydrate Matrix on Wood Properties. (3). Effect of Degradation on the Hydrophilic nature of Birchwood."

Paperchem Abstract No. 48–09046 of J. Adhesion 9, No. 1: 63–71 (1977): Description of Tinh et al., "Effects of Etraction on Wettabiligy and Glueability of Apitong (Dipterocarpus Grandiflorus Blanco)." (Month Unknown).

Paperchem Abstract No. 48–01437 of Polymer 18, No. 4: 315–318 (Apr. 1977): Description of Abou–State et al., "Cold Alkali Refining of Cellulosic Pulps Derived From Egyptian Cotton and Bagasse."

Paperchem Abstract No. 65–06313 of Przegl. Wlok. 46, No. 11: 276–279 (Nov. 1992). (Pol.): Description of Bartos, "Effect of Catalysts on Alkaline Scouring of Cellulosic Fabrics."

Paperchem Abstract No. 64–06498 of US 5,124,197: Description of Bernardin et al., "Inflated Cellulose Fiber Web Possessing Improved Vertical Wicking Properties." (Date Unknown).

Paperchem Abstract No. 64–03782 of US 5,112,690: Description of Cohen et al., "Low–Hydrohead Fibrous Porous Web With Improved Retentive Wettability." (Date Unknown).

Paperchecm Abstract No. 63–02330 of US 5,059,282: Description of Ampulski et al., "Soft Tissue Paper." (Date Unknown).

Paperchem Abstract No. 62–03021 of Dtsch. Papierwirtsch. No. 4: V8–10, V12, V39–40 (1990). (Ger. & Engl.): Description of Gerstenberg, "Corona PRetreatment to Allow Weeting and Bonding." (Month Uknown).

Paperchem Abstract No. 56–07536 of Holzforschung 39, No. 4: 239–243 (Aug. 1985). (Fr., Engl., & Ger. Sum.): Description of Rozumek et al., "Study of the Wettability of Maritime Pine by a Urea–Formaldehyde Resin."

Paperchem Abstract No. 53–02975 of Research Disclosure No. 208: 324–325 (Aug. 1981); Description of "Resin–Treated Cellulosic Fibers and Process for Their Manufacture."

Paperchem Abstract No. 51–03874 of USSR Patent 732, 427: Description of Nelovkaya et al., "Composition For Mercerizing Cellulosic Textiles." (Date Unknown).

Paperchem Abstract No. 49–02811 of INDA Tech. Symp. Nonwoven Technology (Atlanta) 6: 83–91 (Mar. 1978): Description of Schyler et al., "Bonding of Hydrophobic–Fiber Nonwovens: Effect of Some Colloidal Properties of Latex Binders."

Paperchem Abstract No. 48–08855 of US 4,049,764: Description of Sigl et al., "Method of Forming Highly Absorbent Filaments and Webs Having Improved Softness, Wicking, and Solvent Drying Characteristics." (Date Unknown).

Paperchem Abstract No. 48–05536 of US 4,028,452: Description of Driscoll, "Additives to Improve Wettability of Synthetic Paper Pulp." (Date Unknown).

Paperchem Abstract No. 46–02982 of US 3,878,138: Description of Keegan et al., "Anhydrous Products Having Improved Wettability Characteristics." (Date Unknown).

Paperchem Abstract No. 42–08583 of US 3,592,194: Description of Duncan, "Diaper having Improved Wicking and Dryness." (Date Unknown).

Paperchem Abstract No. 38–07232 of US 3,339,550: Description of Van Haaften, "Sanitary Napkin With Cross–Linked Cellulosic Layer." (Date Unknown).

Pira Abstract No. 20013379 of Nord. Pulp Pap. Res. J., vol. 9, No. 2, Jun. 1994, pp. 72–75: Description of Carlsson et al., "Improved Wettability of Chemithermomechaical Pulp By Oygen Plasma Treatment."

Pira Abstract No. 20013218 of Nonwovens Mark., vol. 9, No. 14, Jul. 1994, p. 7: Description of Anon, "Cellulosic Fiber of Improved Wettability."

Pira Abstract No. 10270513 of Paper presented at Tachtextil Symposium, Frankfurt, Germany, Jun. 1993: Description of Vanlandeghem, "Gas Plasma Treatment of Fibres."

Pira Abstract No. 10279671 of Med. Text., Mar. 1993: Description of Anon, "Inflated Cellulose Fibres Give Improved Wicking Properties."

Pira Abstract No. 10076180 of Med. Text., Jun. 1991: Description of Anon, "Absorbent Web With Improved Wicking."

Pira Abstract No. 6829251 of Pap. Druck, vol. 35, No. 1, Jan. 1986: Description of Kastner, "Wetting Processes on Paper and Foils."

Heuser, Emil, "The Reaction of Cellulose With Aqueous Alkalies," *The Chemistry of Cellulose*, John WIley & Sons, New York, 1944, pp. 63–65. (Month Unknown).

Rydholm, Sven A., "Carbohydrate–Removing Methods," *Pulping Processes*, Interscience Publishers, New York, 1965, pp. 992–1003. (Month Unknown).

TREATMENT PROCESS FOR CELLULOSIC FIBERS

This application claims the benefit of U.S. Provisional application No. 60/029,343 filed on Oct. 31, 1996

BACKGROUND OF THE INVENTION

1. Field of the Invention

The present invention relates to a process for treating cellulosic fibers. The cellulosic fibers prepared from such a process may be used to prepare a handsheet or other structure that may be used in a disposable absorbent product intended for the absorption of fluids such as body fluids.

2. Description of the Related Art

A variety of chemical treatments of cellulosic fibers are known. An example of a well known chemical treatment of cellulosic fibers is a mercerization process wherein cellulosic fibers are treated with, typically, sodium hydroxide under suitable conditions to convert the cellulose from its native form into a more thermodynamically stable, less crystalline form. Because the mercerized cellulose is less crystalline and more amorphous, the mercerized cellulose is generally more accessible for further treatment with additional reagents.

Known processes for chemically treating cellulosic fibers typically disperse the cellulosic fibers in a solvent, such as an aqueous solution. However, it has been generally recognized that in order to ensure proper mixing of the cellulosic fibers and whatever chemicals are being used to treat the cellulosic fibers as well as to ease the bulk transport of the treatment mixture, such known processes must have the cellulosic fibers present in the solvent at a low consistency. Such processes therefore generally result in the use of more of the solvent in which the chemical treatment takes place, or the chemical treatment agent being used, than would ideally be needed, thereby increasing the costs of manufacturing the chemically treated cellulosic fibers. Additionally, the use of sodium hydroxide, or other caustic agents, typically requires specialized handling procedures as well as recycling processes to ensure that such materials are not discharged to the environment.

It is therefore an object of the present invention to provide a process for the preparation of treated cellulosic fibers in which the amount of solvent and chemical treatment agents used in the process is minimized.

It is also an object of the present invention to provide a process for the preparation of treated cellulosic fibers in which the cellulosic fibers are essentially uniformly chemically treated.

It is also an object of the present invention to provide a process for the preparation of treated cellulosic fibers in which relatively high temperatures may be used.

It is also an object of the present invention to provide a process for the preparation of treated cellulosic fibers which will significantly reduce the costs of manufacturing.

SUMMARY OF THE INVENTION

The present invention concerns an efficient and effective manner for treating cellulosic fibers as well as the treated cellulosic fibers prepared from such a process.

One aspect of the present invention concerns a process for treating cellulosic fibers wherein the cellulosic fibers are treated as a high-consistency mixture with water and an alkali metal hydroxide.

One embodiment of such a process for treating cellulosic fibers comprises:

a) preparing a first mixture comprising a weight amount of cellulosic fibers and a weight amount of water, wherein the cellulosic fibers are present at a consistency of between about 27 to about 100 weight percent based upon the total weight amount of cellulosic fibers and water present in the first mixture, b) preparing a second mixture by adding a weight amount of alkali metal hydroxide to the first mixture, wherein the alkali metal hydroxide is present in the second mixture at a concentration of between about 5 to about 55 weight percent based upon the total weight amount of alkali metal hydroxide and water present in the second mixture, and the cellulosic fibers are present at a consistency of between about 27 to about 90 weight percent based upon the total weight amount of cellulosic fibers and water present in the second mixture;

c) treating the second mixture under conditions effective for the second mixture to form an essentially homogeneous second mixture;

d) treating the essentially homogeneous second mixture under conditions effective for the treated cellulosic fibers to exhibit a Wet Curl value that is greater than about 0.25; and e) recovering the treated cellulosic fibers.

In another aspect, the present invention concerns an absorbent structure comprising treated cellulosic fibers prepared by the process disclosed herein.

One embodiment of such an absorbent structure is a handsheet comprising the treated cellulosic fibers prepared by the process disclosed herein, wherein the handsheet is prepared by a wet-laid process.

DETAILED DESCRIPTION OF THE PREFERRED EMBODIMENTS

It has been discovered that, by using a high-consistency mixture of cellulosic fibers in water and by using appropriate treatment conditions, treated cellulosic fibers may be prepared by an efficient and effective process.

A wide variety of cellulosic fibers can be employed in the process of the present invention. Illustrative cellulosic fibers include, but are not limited to, wood and wood products, such as wood pulp fibers; non-woody paper-making fibers from cotton, from straws and grasses, such as rice and esparto, from canes and reeds, such as bagasse, from bamboos, form stalks with bast fibers, such as jute, flax, kenaf, cannabis, linen and ramie, and from leaf fibers, such as abaca and sisal. It is also possible to use mixtures of one or more cellulosic fibers. Suitably, the cellulosic fiber used is from a wood source. Suitable wood sources include softwood sources such as pines, spruces, and firs, and hardwood sources such as oaks, eucalyptuses, poplars, beeches, and aspens.

As used herein, the term "fiber" or "fibrous" is meant to refer to a particulate material wherein the length to diameter ratio of such particulate material is greater than about 10. Conversely, a "nonfiber" or "nonfibrous" material is meant to refer to a particulate material wherein the length to diameter ratio of such particulate material is about 10 or less.

In the process of the present invention, a first mixture is prepared comprising a weight amount of cellulosic fibers and a weight amount of water. It is desired that the cellulosic fibers be present in the mixtures of the present invention in an amount that is effective to result in a desired structural change in the cellulosic fibers. Generally, if the cellulosic fibers are present in a mixture at too low of a consistency, too much water is being used to make the process cost efficient and easy from a materials handling standpoint. Also, generally, if the cellulosic fibers are present in a mixture at too high of a consistency, there will not be enough water present to effectively swell the cellulosic fibers and also solubilize the alkali metal hydroxide that is added to the mixture so as to fail to result in a desired chemical treatment of the cellulosic fibers.

Thus, in the first mixture, the cellulosic fibers are present at a consistency of between about 27 to about 100 weight percent, beneficially between about 30 to about 100 weight percent, more beneficially between about 35 to about 100 weight percent, most beneficially between about 40 to about 100 weight percent, desirably between about 27 to about 90 weight percent, more desirably between about 30 to about 90 weight percent, even more desirably between about 30 to about 90 weight percent, most desirably between about 40 to about 90 weight percent, suitably between about 27 to about 80 weight percent, more suitably between about 30 to about 80 weight percent, even more suitably between about 35 to about 80 weight percent, and most suitably between about 40 to about 80 weight percent, wherein all weight percents are based upon the total weight amount of cellulosic fibers and water present in the first mixture.

As will generally be appreciated by those skilled in the art, the mixtures of the present invention in which the cellulosic fibers are used at relatively-high consistencies will generally not be in solution form. Instead, because the cellulosic fibers will typically be capable of absorbing an amount of water that is equal to several times the weight of the cellulosic fibers themselves, such relatively-high consistency mixtures will generally be a free-flowing particulate mass that may feel relatively dry to the touch. With such a non-solution form of mixture, it may be necessary to use process equipment different from that typically used for relatively-low consistency mixtures.

As used herein, "consistency" is meant to refer to the concentration of the cellulosic fibers present in a mixture. As such, the consistency will be presented as a weight percent representing the weight amount of the cellulosic fibers present in a mixture divided by the total weight amount of cellulosic fibers and water present in such mixture, multiplied by 100.

The cellulosic fibers are typically mixed with an aqueous solution beneficially comprising at least about 30 weight percent water, suitably about 50 weight percent water, more suitably about 75 weight percent water, and most suitably 100 weight percent water. When another liquid is employed with the water, such other suitable liquids include methanol, ethanol, isopropanol, and acetone. However, the use or presence of such other non-aqueous liquids may impede the formation of a homogeneous mixture such that the cellulosic fibers and the treatment agent, such as an alkali metal hydroxide, do not effectively disperse into the aqueous solution and effectively or uniformly mix with one another.

The first mixture should generally be prepared under conditions that are sufficient for the cellulosic fibers and water to be effectively mixed together. Generally, such conditions will include using a temperature that is between about 10° C. to about 150° C.

In one embodiment of the present invention, after mixing together the cellulosic fibers and water to form a first mixture, such a first mixture is beneficially agitated, stirred, or otherwise blended to effectively uniformly mix the cellulosic fibers and water such that essentially all of the cellulosic fibers are wetted by the water and an essentially homogeneous mixture is formed. Such wetting of the cellulosic fibers will begin to swell the cellulosic fibers so that such swollen cellulosic fibers are in a more favorable condition for treatment with an alkali metal hydroxide. In general, the blending of the first mixture may be done for any effective amount of time such as beneficially between about 5 to about 60 minutes.

It has been found that, in the process of the present invention, it is desired that the cellulosic fibers be first added to the water before, as discussed later herein, the addition of any substantial amount of treatment agents, such as alkali metal hydroxides. This is believed to be because, since the cellulosic fibers are present in the mixtures of the present invention at such relatively high consistencies, the cellulosic fibers must be first mixed with water so that the cellulosic fibers will begin to swell so that such swollen cellulosic fibers are in a more favorable condition for treatment with an alkali metal hydroxide. In contrast, if relatively dry and unswollen cellulosic fibers are added to an aqueous alkali metal hydroxide solution to prepare the relatively-high consistency mixtures as desired herein, there will not be an adequate amount of water present in the mixture to ensure a uniform distribution of the alkali metal hydroxide throughout the dry cellulosic fibers so as to result in an effective treatment of all of the cellulosic fibers.

In the process of the present invention, an alkali metal hydroxide is used as a treatment agent and is added to a first mixture of cellulosic fibers and water. Alkali metal hydroxides useful in the process of the present invention include, but are not limited to, sodium hydroxide, potassium hydroxide, and lithium hydroxide. Due to cost and handling considerations, sodium hydroxide is most suitably used in the process of the present invention.

The alkali metal hydroxide is added to the first mixture, comprising cellulosic fibers and water, so as to prepare a second mixture comprising cellulosic fibers, water, and the alkali metal hydroxide. It is desired that the alkali metal hydroxide be present in the second mixture in an amount that is effective to result in a desired degree of swelling as well as a desired super-molecular structural modification in the cellulosic fibers. Generally, if the alkali metal hydroxide is present in the second mixture in too low of a concentration, there will not be an effective amount of super-molecular structural modification of the cellulosic fibers. Also, generally, if the alkali metal hydroxide is present in the second mixture in too high of a concentration, the degree of swelling of the cellulosic fibers will be so low as to prevent an effective amount of super-molecular structural modification of the cellulosic fibers from occurring.

As used herein, a "degree of swelling of the cellulosic fibers" is meant to refer to the increase in the diameter of cellulosic fibers as the cellulosic fibers are treated with the alkali metal hydroxide. As such, the degree of swelling of the cellulosic fibers will be presented as a ratio of the final, average diameter exhibited by cellulosic fibers after being treated with the alkali metal hydroxide compared to the original, average diameter exhibited by the cellulosic fibers before being treated with the alkali metal hydroxide.

A hypothetical example which would satisfy this definition of the degree of swelling of the cellulosic fibers would be a sample of cellulosic fibers, before being treated with alkali metal hydroxide, that exhibits an average diameter of a relative value of two (2). After being treated with the alkali metal hydroxide, the cellulosic fibers exhibit an average diameter of a relative value of three (3). As such, the treated cellulosic fibers exhibit a degree of swelling that is 1.5. Generally, when treated with an alkali metal hydroxide, cellulosic fibers will exhibit a degree of swelling that is between about 1 to about 2.

Generally, the degree of swelling exhibited by a cellulosic fiber will be dependent on the type of alkali metal hydroxide being used, the concentration of the alkali metal hydroxide being used, and the temperature at which the chemical treatment of the cellulosic fibers is taking place. The degree of swelling of cellulosic fibers when treated with an alkali metal hydroxide is a known phenomenon. As such, the expected degree of swelling to be exhibited by cellulosic fibers under specified conditions may be found in the literature as, for example, in the *Journal of Applied Polymer Science,* J. O. Warwicker, Vol. 69, Issue 13, 1941.

Thus, the alkali metal hydroxide is added to the first mixture in a weight amount so that the alkali metal hydroxide is present in the second mixture at a concentration of between about 5 to about 55 weight percent, beneficially between about 8 to about 55 weight percent, more beneficially between about 8 to about 50 weight percent, suitably between about 13 to about 55 weight percent, and more suitably between about 13 to about 50 weight percent, wherein all weight percents are based upon the total weight amount of alkali metal hydroxide and water present in the second mixture.

In one embodiment of the present invention, it is desired that the alkali metal hydroxide be present in the second mixture in an amount, and the second mixture is treated under conditions, that are effective to result in the mercerization of the cellulosic fibers. Generally, in order to result in the mercerization of the cellulosic fibers, the alkali metal hydroxide must be present in the second mixture at a concentration that is greater than about 13 weight percent, based upon the total weight amount of alkali metal hydroxide and water present in the second mixture. Conditions effective to result in the mercerization of the cellulosic fibers generally include using an effective temperature.

As used herein, "mercerization" is meant to refer to a process wherein cellulosic fibers are treated under suitable conditions to convert the cellulose from its native form, sometimes referred to as cellulose I, into another crystalline form, sometimes referred to as cellulose II. Because the chemically treated or mercerized cellulose is less crystalline and more amorphous, the chemically treated or mercerized cellulose is generally more accessible for further treatment with additional reagents. Known test methods exist for quantifying the chemical treatment, such as the degree of mercerization that occurs, of cellulosic fibers. As used herein, the degree of mercerization of cellulosic fibers is intended to represent the weight percent of a cellulosic fiber sample that has been mercerized by a treatment process. As used herein, the chemical treatment or mercerization of cellulosic fibers may be quantified according to TAPPI test method T 401 om-93, wherein Graff "C" stain is used. TAPPI test method T 401 om-93 is hereby incorporated in its entirety by reference. Generally, this test procedure includes placing a cellulosic fiber sample onto a slide and then contacting the cellulosic fibers with the Graff "C" stain. Once stained, chemically treated or mercerized cellulosic fibers, such as softwood sulfate-bleached cellulosic fibers, generally exhibit a dusty rose to a deep magenta color as compared to the dark bluish-gray to dusty purple exhibited by untreated or unmercerized softwood sulfate-bleached cellulosic fibers.

The stained slide is placed into position under a microscope and then slowly moved in a horizontal direction. The number of chemically treated or mercerized and untreated or unmercerized cellulosic fibers crossing or touching the horizontal cross-hair are counted. A weight factor of 1.45 was used to modify the total counts because of the type of wood used. The degree of chemical treatment or mercerization may then be calculated and reported as a weight percentage.

In one embodiment of the present invention, it is desired that the cellulosic fibers be treated such that the degree of chemical treatment or mercerization achieved with the treated cellulosic fibers is greater than about 75 percent, beneficially greater than about 80 percent, more beneficially greater than about 85 percent, suitably greater than about 90 percent, more suitably greater than about 95 percent, and up to about 100 percent.

The alkali metal hydroxide may be added to the first mixture in solid form or as an aqueous alkali metal hydroxide solution. If the alkali metal hydroxide is added as an aqueous alkali metal hydroxide solution, the amount of additional water added to the first mixture, in addition to the water already present in the first mixture, should still result in the cellulosic fibers being present in the second mixture at a consistency of between about 27 to about 90 weight percent, beneficially between about 30 to about 90 weight percent, more beneficially between about 35 to about 90 weight percent, most beneficially between about 40 to about 90 weight percent, desirably between about 27 to about 80 weight percent, more desirably between about 30 to about 80 weight percent, even more desirably between about 30 to about 80 weight percent, most desirably between about 40 to about 80 weight percent, suitably between about 27 to about 70 weight percent, more suitably between about 30 to about 70 weight percent, even more suitably between about 35 to about 70 weight percent, and most suitably between about 40 to about 70 weight percent, wherein all weight percents are based upon the total weight amount of cellulosic fibers and water present in the second mixture.

Once the second mixture, comprising cellulosic fibers, water, and alkali metal hydroxide, has been prepared, it is desired that the second mixture be treated under conditions that are effective for the second mixture to form an essentially homogenous second mixture so as to ensure the later effective treatment of essentially all of the cellulosic fibers. Such conditions may include treating the second mixture at a temperature that is between about 10° C. to about 120° C., beneficially between about 20° C. to about 80° C., and forming the mixture with agitation. It is generally desired to use a relatively higher temperature to reduce the amount of time necessary to form the essentially homogenous second mixture.

In general, once the essentially homogenous second mixture has been prepared, it is desired that the second mixture be treated under conditions that are effective for essentially all of the cellulosic fibers to be effectively treated. In general, it will be desired to reduce the temperature at which the mixture is being treated. This is because treatment of cellulosic fibers using an alkali metal hydroxide is generally more efficient and occurs more readily at a relatively lower temperature. As such, it is generally desired that the essentially homogenous second mixture be treated at a temperature that is between about −20° C. to about 100° C. and beneficially between about 0° C. to about 50° C. In general, the chemical treatment of the cellulosic fibers may be done for any effective amount of time such as beneficially between about 5 to about 60 minutes.

In one embodiment of the present invention, however, it is desired that the essentially homogenous second mixture be treated at a temperature that is between about 50° C. to about 100° C., beneficially between about 50° C. to about 80° C., and suitably between about 60° C. to about 80° C. It has been discovered that under the relatively high cellulosic fiber consistency and relatively high alkali metal hydroxide concentration conditions of the present invention, such relatively high temperatures may be used and a desired modification of the cellulosic fibers is still achieved along with substantially no degradation of the cellulosic fibers. This was found to be surprising because known methods for treating cellulosic fibers with alkali metal hydroxides generally stress the importance of practicing at relatively low temperatures in order to achieve desirable modification of the cellulosic fibers since the use of lower temperatures generally increases the swelling of the cellulosic fibers and minimizes the amount of degradation that might occur within the cellulose fibers.

The precise chemical and physical reasons for the surprising success of such a high-temperature, high-consistency embodiment of the present invention are not fully understood. Without intending to be bound hereby, it may be that the chemical activities of the aqueous components in the mixture may be altered under the high-consistency conditions of the present invention in a way which promotes effective modification of the cellulosic fibers in the high-consistency mixture without excessive cellulosic fiber degradation. It may also be that the combination of high-energy and high-consistency mechanical processing allows for non-degrading mechanical treatment of the cellulosic fibers while also providing adequate chemical uniformity to prevent overexposure of some portions of the cellulosic fibers to the reactive alkali metal hydroxide mixture under high temperature conditions. If the discovered process inherently improves uniformity of treatment, as it may, then nearly all of the cellulosic fibers can be treated for the proper amount of time to achieve the desired degree of chemical and mechanical modifications without overtreating and thus degrading some portions of the cellulosic fibers.

Regardless of the physical and chemical mechanisms involved, the discovery of a high-temperature alkali metal hydroxide treatment process helps fulfill a long felt need to produce alkali metal hydroxide modified cellulosic fibers at lower cost, for known commercial processing methods which rely on low temperature treatment are highly expensive. Having broken the paradigm that alkali metal hydroxide treatment requires low temperatures, it should now be possible to propose commercial processes capable of producing alkali metal hydroxide treated cellulosic fibers at much less than the cost of prior art methods. Once a technique for high temperature alkali metal hydroxide treatment was discovered, dramatic cost reductions could be forecast because a conventional bleached cellulosic fiber pulp, produced at elevated temperatures in a typical pulp mill, could be used in conjunction with already available alkali metal hydroxide liquors from such a mill to generate alkali metal hydroxide treated cellulosic fibers. The primary expense would be in providing an appropriate high consistency treatment stage according to certain embodiments of this invention, but the previously expected large capital and operating expenses for stages of cooling, dilution, and treatment with relatively dilute solutions of cellulosic fibers and alkali metal hydroxide would no longer be an economic burden to be borne. Therefore, certain embodiments of the present invention have the potential to provide large quantities of alkali metal hydroxide treated cellulosic fibers at a traditional bleached pulp mill at a net cost almost half of that incurred in prior art processes.

In addition to the unexpected ability to obtain high-quality alkali metal hydroxide treated cellulosic fibers under high temperature reaction conditions, certain embodiments of the present invention also appear to unexpectedly overcome previously taught restrictions in washing, dilution, or quenching of the reacted product. In general, prior art processes disclose that the use of relatively hot water to wash alkali metal hydroxide treated cellulosic fibers can cause loss of any modification of the treated cellulosic fibers. Those skilled in the art have generally avoided elevated temperatures altogether for washing the treated cellulosic fibers and are believed to use water not significantly hotter than room temperature. In one embodiment of the process of the present invention, already heated process water or dilute liquor can be used having temperatures above about 50° C. without known adverse effects to the treated cellulosic fibers.

In addition to a novel ability to treat cellulosic fibers with alkali metal hydroxide above about 50° C., the temperature of the washing liquor (or, in other words, the quenching temperature) can also be higher than previously known in the art. Rather than the known near-room temperature washing and dilution processes, washing can now be done at temperatures much closer to boiling levels, such as in the range of about 50° C. to about 90° C. The temperature of washing can be lower, of course, and could comprise temperatures above about 0° C., beneficially above about 20° C., more beneficially above about 40° C., suitably in the range of between about 50° C. to about 90° C., and most suitably in the range of between about 60° C. to about 80° C., which is an especially convenient range of wash liquor temperature in a pulp mill. Given widespread prior art teachings about the desirability of relatively low temperatures for treatment with alkali metal hydroxides, and given the widespread prior art teachings of conducting treatment with alkali metal hydroxides in low or medium consistency pulp, the success of using a relatively high-temperature, high-consistency process was unexpected and surprising to experienced pulp and paper chemists. Apparently, however, the combination of conditions and process steps in certain embodiments of the present invention has opened up an unexpected window of opportunity in the mercerization and general alkali metal hydroxide treatment of cellulosic fibers. The ability to produce high-quality mercerized fibers with existing process streams at a pulp mill under high temperature and high temperature conditions has the potential to lead to greatly reducing the cost of alkali metal hydroxide treated cellulosic fibers.

In one embodiment of the present invention, it is desired that the weight ratio of the water to the cellulosic fibers in the essentially homogeneous second mixture is not less than the saturated weight ratio of water to the cellulosic fibers based on the degree of swelling of the cellulosic fibers in an equilibrium state. Such a condition will ensure that there is sufficient water present in the mixture to ensure a uniform distribution of the alkali metal hydroxide throughout the cellulosic fibers so as to result in an effective chemical treatment of all of the cellulosic fibers.

In one embodiment of the present invention, it has been discovered that the cellulosic fibers can be treated in a high energy refiner to provide desired curl properties to the fiber. In accordance with this embodiment of the invention, the high-energy refining of the treated cellulosic fibers to an effective level of stable curls results in significant and unexpected improvements in the properties of the treated cellulosic fibers.

Cellulosic fibers suitable for use in the present invention are generally without a substantial amount of curl prior to treatment with an alkali metal hydroxide and subsequent or concurrent high-energy refining of the cellulosic fibers to provide the curled treated cellulosic fibers as disclosed herein. After such treatment processes, the treated cellulosic fibers will generally exhibit a desired level of stable curl. It is believed that the modification of the cellulosic fibers by treatment with an alkali metal hydroxide generally reduces the softening temperature of the cellulosic fibers, thereby making the cellulosic fibers more conformable and pliable. Such an increase in the conformability of the modified cellulosic fibers generally results in the modified cellulosic fibers being favorable to the development of curl by the application of mechanical energy. Such a change in the softening properties of the cellulosic fibers is thus utilized in this embodiment of the present invention to achieve a high curl factor in the modified cellulosic fibers by the method of mechanical dispersing. As such, the process of the present invention generally does not require the use of any additional additives to the cellulosic fibers during the high-energy refining process or any post-treatment steps, such as curing or similar heat-treatments, after the high-energy refining of the fibers to achieve the desired curls. It is believed that the modified cellulosic fibers of the present invention are capable of being set into their highly curled state when the alkali metal hydroxide is removed from the mixture as, for example, by washing the mixture with water.

Thus, either concurrently with or subsequent to the treatment of the cellulosic fibers with an alkali metal hydroxide, the cellulose fibers may be treated with a high-energy refining process to achieve a desired amount of fiber curl. The curling of the modified cellulosic fibers herein can generally be achieved by using a curlator which provides significant fiber-to-fiber contact and is capable of imparting sufficient energy to curl the cellulosic fibers. A suitable method of curling the modified cellulosic fibers includes the use of suitable shaft dispersers. A variety of shaft dispersers or equivalent mechanical devices are believed capable of being suitable to obtain the desired amount of curl in the modified cellulosic fibers of the present invention. Suitable shaft dispersers include, without limitation, nonpressurized shaft dispersers and pressurized shaft dispersers. The consistency of a mixture comprising the cellulosic fibers subjected to dispersing must generally be sufficiently high to provide effective fiber-to-fiber contact.

The temperature used during a high-energy refining process may generally be at any effective temperature, but is beneficially greater than about 25° C., suitably greater than about 40° C., more suitably greater than about 60° C. and most suitably greater than about 100° C. In general, the upper limit for the temperature used in the process is dependent on the equipment being used and if such equipment can be pressurized since at sufficiently high temperatures the water in the cellulose fiber pulp will boil. However, it is generally desirable to use as high of a temperature as is possible since the use of higher temperatures will generally result in improved curl of the modified fibers as compared to the use of lower temperatures.

A typical high-energy disperser is a shaft disperser, available from Ing. S. Maule & C. S.p.A., Torino, Italy, under the designation type GR II shaft disperser. Such a device comprises an upper cylindrical housing and lower cylindrical housing which when closed encloses a rotating shaft provided with a multiplicity of arms. The upper cylindrical housing has three rows of knurled fingers, three inspection ports and an inlet port at one end. A drive motor for turning the shaft is provided at the inlet end along with a bearing assembly at the outlet end. The inlet end of the rotating shaft has a screw feed section to move a mixture comprising cellulosic fibers coming through the inlet port into the disperser. At the outlet end of the disperser is a hinged flap to adjust the outlet opening from the disperser. The opening of the hinged flap is controlled by air bags and this is used to adjust the back pressure in the disperser. Increasing the back pressure in the disperser increases the degree to which the cellulosic fibers are worked, leading to a higher curl factor. Steam can be injected into the feed stream to elevate the dispersing temperature. Typical conditions for using such a disperser include an energy level of about 2.0 horsepower-day per ton of cellulosic fiber mixture and a feed rate of cellulosic fiber mixture of about 1000 pounds per hour.

Another typical high-energy disperser is a machine available from Clextral Company, Firminy Cedex, France, under the designation Bivis high-energy disperser. The Bivis high-energy disperser is a twin screw disperser. A mixture comprising cellulosic fibers is introduced through an inlet where the mixture encounters a short feed screw. The feed screw transfers the mixture comprising cellulosic fibers to a first working zone. The working zone consists of a pair of intermeshing screws which are enclosed in a cylindrical housing. The screws co-rotate to transport the mixture comprising cellulosic fibers axially through the disperser. High energy dispersing is achieved by using reverse-flighted screws which have small slots machined in the flights. Reverse-flighted screws are positioned periodically along the length of both screws and serve to reverse the flow of mixture comprising cellulosic fibers through the machine, thereby introducing back pressure. Pressure builds up in this zone and forces the mixture comprising cellulosic fibers to flow through the slots in the reverse flights into the next forward flighted screw section which is at a lower pressure. This compression/expansion action imparts a high energy to the mixture comprising cellulosic fibers during dispersion. Steam can be injected into the mixture comprising cellulosic fibers to carry out high temperature dispersing. Typical conditions for using such a disperser include an energy level of about 6.0 horsepower-day per ton of cellulosic fiber mixture and a feed rate of cellulosic fiber mixture of about 2000 pounds per hour.

Cellulosic fibers treated according to the process of the present invention generally have different structural properties as compared to untreated cellulosic fibers. In one aspect, treated cellulosic fibers will exhibit a generally round, rope-like cross-sectional shape as opposed to the generally flat, ribbon-like shape of untreated cellulosic fibers. Such a generally round, rope-like cross-sectional shape generally results in the treated cellulosic fibers being more stiff and more resilient than untreated cellulosic fibers. It is generally desired that cellulosic fibers be relatively more stiff and relatively more resilient because such properties generally add to the bulk and stability, and particularly in a wet state, of a fibrous matrix prepared from the cellulosic fibers.

In one embodiment of the present invention, the cellulosic fibers will be considered to be effectively treated by the alkali metal hydroxide when the cellulosic fibers exhibit an effective Wet Curl value. During treatment with alkali metal hydroxide alone or in combination with treatment with mechanical energy, a cellulosic fiber often has a curl imparted to it such that the fiber is no longer straight and becomes shortened. Furthermore, the curl of a cellulosic fiber has been found to generally be more stable when the cellulosic fiber is treated with both alkali metal hydroxide and mechanical energy as compared to when the cellulosic fiber is treated only with mechanical energy.

The curl of a fiber may be quantified by a curl value which measures the fractional shortening of a fiber due to kink, twists, and/or bends in the fiber. For the purposes of this invention, a fiber's curl value is measured in terms of a two dimensional plane, determined by viewing the fiber in a two dimensional plane. To determine the curl value of a fiber, the projected length of a fiber as the longest dimension of a two dimensional rectangle encompassing the fiber, I, and the actual length of the fiber, L, are both measured. An image analysis method may be used to measure L and I. A suitable image analysis method is described in U.S. Pat. No. 4,898,642, incorporated herein in its entirety by reference. The curl value of a fiber can then be calculated from the following equation:

$$\text{Curl Value}=(L/I)-1$$

Depending on the nature of the curl of a cellulosic fiber, such curl may be stable when the cellulosic fiber is dry but may be unstable when the cellulosic fiber is wet. The cellulosic fibers prepared according to the process of the present invention have been found to exhibit a substantially stable fiber curl when wet. This property of the cellulosic fibers may be quantified by a Wet Curl value, as measured according to the test method described herein, which is a length weighted mean curl average of a designated number of fibers, such as about 4000, from a fiber sample. As such, the Wet Curl value is the summation of the individual wet curl values for each fiber multiplied by the fiber's actual length, L, divided by the summation of the actual lengths of the fibers. It is hereby noted that the Wet Curl value, as determined herein, is calculated by only using the necessary values for those fibers with a length of greater than about 0.4 millimeter.

As used herein, the cellulosic fibers will be considered to be effectively treated by the alkali metal hydroxide when the cellulosic fibers exhibit a Wet Curl value that is greater than about 0.25, beneficially between about 0.25 to about 0.6, and suitably between about 0.27 to about 0.5. In contrast, cellulosic fibers that have not been treated generally exhibit a Wet Curl value that is less than about 0.2.

After the cellulosic fibers have been effectively treated, the treated cellulosic fibers are desirably recovered from the second mixture. In general, any method of recovering the treated cellulosic fibers without unacceptably negatively affecting the treated cellulosic fibers is suitable for use in the present invention. In general, the treated cellulosic fibers will be washed with water and neutralized with any suitable acid, such as acetic acid or sulfuric acid, to a pH of about 6 or 7. However, depending on if any additional processing procedures are planned or the specific use for which the treated cellulosic fibers are intended, other recovery and post-treatment steps are also well known.

In one embodiment of the present invention, the solution resulting from the post-treatment washing of the cellulosic fibers may be recycled within the overall process system by being used, for example, as the alkali metal hydroxide solution added to the first mixture comprising the cellulosic fibers and water. In such a way, the alkali metal hydroxide does not need to be discharged to the environment and a relatively small amount of the alkali metal hydroxide needs to be used in the overall process since relatively little of the alkali metal hydroxide is actually consumed or used up during the treatment of the cellulosic fibers.

The cellulosic fibers treated according to the process of the present invention are suited for use in disposable absorbent products such as diapers, adult incontinent products, and bed pads; in catamenial devices such as sanitary napkins, and tampons; other absorbent products such as wipes, bibs, wound dressings, and surgical capes or drapes; and tissue-based products such as facial or bathroom tissues, household towels, wipes and related products. Accordingly, in another aspect, the present invention relates to a disposable absorbent product comprising the cellulosic fibers treated according to the process of the present invention.

In one embodiment of the present invention, the treated fibers prepared according to the process of the present invention are formed into a handsheet which might represent a tissue-based product. Such a handsheet may be formed by either a wet-laid or an air-laid process. A wet-laid handsheet may be prepared according to the method disclosed in the Test Procedures section herein.

It has been discovered that a wet-laid handsheet prepared from the treated cellulosic fibers prepared according to the process of the present invention may exhibit a density that is lower than a wet-laid handsheet prepared from cellulosic fibers that have not been treated according to the process of the present invention.

It has also been discovered that a wet-laid handsheet prepared from the treated cellulosic fibers prepared according to the process of the present invention may exhibit a liquid wicking time that is faster than a wet-laid handsheet prepared from cellulosic fibers that have not been treated according to the process of the present invention.

It has also been discovered that a wet-laid handsheet prepared from the treated cellulosic fibers prepared according to the process of the present invention may exhibit a liquid wicking flux that is higher than a wet-laid handsheet prepared from cellulosic fibers that have not been treated according to the process of the present invention.

In one embodiment of the present invention, the treated cellulosic fibers prepared according to the process of the present invention are formed into a fibrous matrix for incorporation into an absorbent structure. A fibrous matrix may take the form of, for example, a batt of comminuted wood pulp fluff, a tissue layer, a hydroentangled pulp sheet, or a mechanically softened pulp sheet. Suitably, the fibrous matrix is formed so as to constrain or entrap a hydrogel-forming polymeric material within, or onto, its structure. The hydrogel-forming polymeric material may be incorporated into or onto the fibrous matrix either during or after the formation of the general form of the fibrous matrix.

As used herein, "hydrogel-forming polymeric material" is meant to refer to a high absorbency material commonly referred to as a superabsorbent material. Such high absorbency materials are generally capable of absorbing an amount of a liquid, such as synthetic urine, a 0.9 weight percent aqueous saline solution, or bodily fluids, such as menses, urine, or blood, at least about 10, suitably about 20, and up to about 50 times the weight of the superabsorbent material at the conditions under which the superabsorbent material is being used. Typical conditions include, for example, a temperature of between about 0° C. to about 100° C. and suitably ambient conditions, such as about 23° C. and about 30 to about 60 percent relative humidity. Upon absorption of the liquid, the superabsorbent material typically swells and forms a hydrogel.

The superabsorbent material may be formed from an organic hydrogel material which may include natural materials, such as agar, pectin, and guar gum, as well as synthetic materials, such as synthetic hydrogel polymers. Synthetic hydrogel polymers include, for example, carboxymethyl cellulose, alkali metal salts of polyacrylic acid, polyacrylamides, polyvinyl alcohol, ethylene maleic anhydride copolymers, polyvinyl ethers, hydroxypropyl cellulose, polyvinyl morpholinone, polymers and copolymers of vinyl sulfonic acid, polyacrylates, polyacrylamides, and polyvinyl pyridines. Other suitable hydrogel polymers include hydrolyzed acrylonitrile grafted starch, acrylic acid grafted starch, and isobutylene maleic anhydride copolymers and mixtures thereof. The hydrogel polymers are preferably lightly crosslinked to render the material substantially water insoluble yet water swellable. Crosslinking may, for example, be by irradiation or covalent, ionic, van der Waals, or hydrogen bonding. Suitable superabsorbent materials are typically available from various commercial vendors, such as The Dow Chemical Company, Hoechst Celanese, Allied Colloids Limited, or Stockhausen, Inc.

The hydrogel-forming polymeric material, employed in the absorbent structures or products of the present invention, suitably should be able to absorb a liquid under an applied load. For the purposes of this application, the ability of a hydrogel-forming polymeric material to absorb a liquid under an applied load, and thereby perform work, is quantified as the Absorbency Under Load (AUL) value. The AUL value is expressed as the amount (in grams) of an aqueous 0.9 weight percent sodium chloride solution which the hydrogel-forming polymeric material can absorb in about 60 minutes per gram of hydrogel-forming polymeric material under a load of about 0.3 pound per square inch (approximately 2.0 kilopascals) while restrained from swelling in the plane normal to the applied load. The hydrogel-forming polymeric material employed in the absorbent structures of the present invention suitably exhibit an AUL value of at least about 15, more suitably of at least about 20, and up to about 50 grams of liquid per gram of hydrogel-forming polymeric material. The method by which the AUL value may be determined is set forth, for example, in detail in U.S. Pat. No. 5,149,335 or U.S. Pat. No. 5,247,072, incorporated herein by reference.

Suitably, the hydrogel-forming polymeric material is in the form of particles which, in the unswollen state, have maximum cross-sectional diameters within the range of from about 50 micrometers to about 1000 micrometers, preferably within the range of from about 100 micrometers to about 800 micrometers, as determined by sieve analysis according to American Society for Testing and Materials (ASTM) test method D-1921. It is to be understood that the particles of hydrogel-forming polymeric material falling within the ranges described above may comprise solid particles, porous particles, or may be agglomerated particles comprising many smaller particles agglomerated into particles falling within the described size ranges.

The hydrogel-forming polymeric material is typically present in an absorbent structure or product of the present invention in an amount effective to result in the absorbent structure or product being able to absorb a desired amount of liquid. The hydrogel-forming polymeric material is beneficially present in an absorbent structure in an amount of from about 1 to about 99 weight percent, suitably in an amount of from about 5 to about 95 weight percent, and more suitably of from about 10 to about 90 weight percent, based on the total weight of the hydrogel-forming polymeric material and substrate in the absorbent structure.

A fibrous matrix useful in the present invention may be formed by an air-laying process or a wet-laid process, or by essentially any other process known to those skilled in the art for forming a fibrous matrix.

In one embodiment of the present invention, a disposable absorbent product is provided, which disposable absorbent product comprises a liquid-permeable topsheet, a backsheet attached to the liquid-permeable topsheet, and an absorbent structure positioned between the liquid-permeable topsheet and the backsheet, wherein the absorbent structure comprises treated cellulosic fibers prepared using the process of the present invention.

Exemplary disposable absorbent products are generally described in U.S. Pat. Nos. 4,710,187; 4,762,521; 4,770,656; and U.S. Pat. No. 4,798,603; which references are incorporated herein by reference.

Those skilled in the art will recognize materials suitable for use as the topsheet and backsheet. Exemplary of materials suitable for use as the topsheet are liquid-permeable materials, such as spunbonded polypropylene or polyethylene having a basis weight of from about 15 to about 25 grams per square meter. Exemplary of materials suitable for use as the backsheet are liquid-impervious materials, such as polyolefin films, as well as vapor-pervious materials, such as microporous polyolefin films.

Absorbent products and structures according to all aspects of the present invention are generally subjected, during use, to multiple insults of a body liquid. Accordingly, the absorbent products and structures are desirably capable of absorbing multiple insults of body liquids in quantities to which the absorbent products and structures will be exposed during use. The insults are generally separated from one another by a period of time.

Test Procedures

Degree of Uniformity of Alkali Metal Hydroxide Treatment

The chemical treatment with an alkali metal hydroxide of cellulosic fibers may be quantified according to TAPPI test method T 401 om-93, wherein Graff "C" stain is used. TAPPI test method T 401 om-93 is hereby incorporated in its entirety by reference. Generally, this test procedure includes placing a cellulosic fiber sample onto a slide and then contacting the cellulosic fibers with the Graff "C" stain. Once stained, chemically treated or mercerized cellulosic fibers, such as softwood sulfate-bleached cellulosic fibers, generally exhibit a dusty rose to a deep magenta color as compared to the dark bluish-gray to dusty purple exhibited by untreated or unmercerized softwood sulfate-bleached cellulosic fibers. The stained slide is placed into position under a microscope and then slowly moved in a horizontal direction. The number of chemically treated or mercerized and untreated or unmercerized cellulosic fibers crossing or touching the horizontal cross-hair are counted. A weight factor of 1.45 was used to modify the total counts because of the type of wood used. The degree of uniformity of treatment by alkali metal hydroxide may then be calculated and reported as a weight percentage.

Alpha Cellulose Content

The alpha cellulose content of a cellulose fiber sample represents the portion of a cellulose fiber sample that is insoluble in a 10 weight percent sodium hydroxide aqueous solution. The alpha cellulose content is measured according to the standardized test method TAPPI test method t203 cm-93, incorporated herein in its entirety by reference.

Determination of Cellulose I and Cellulose II Content

A sample of cellulose fibers is pressed into a pellet form, having a diameter of about 1 centimeter, with a Specac hydraulic press. The Raman spectra of the cellulose fiber sample is acquired by using a Bruker RFS 100 FT-Raman or IFS66 FTIR spectrometer with an FRA 106 Raman module.

A Nd:YAG laser operating at 1064 nm is used for excitation at a power level of about 1 000 mW or 300 mW depending on the signal to noise ratio required. Between 200 and 1000 scans are collected, depending on the particular sample, at a spectral resolution of about 4 $cm^{-1}$. The Raman scattered radiation is collected at 180 degrees to the excitation radiation. Blackman-Harris apodization is used in conjunction with the double-sided acquisition mode and a zero filling factor of 2.

The spectral data obtained are converted into Spectra Calc format using Grams32 software, available from Galactic Industries. The spectral region between 800 and 200 cm-1 is leveled using the baseline correction feature of the Grams32 and the baseline offset is set to zero to eliminate baseline background differences between samples. The peak heights of the bands at 379 and 349 cm-1 are obtained from the resulting spectra and are measured. The equation used for calculation of the percentage of cellulose I present in a cellulose fiber sample is:

$$\text{Cellulose } I \text{ (weight percent)} = 100\% \times \frac{(PkHt_{379(FS)}/PkHt_{349(FS)})}{(PkHt_{379(CS)}/PkHt_{349(CS)})}$$

wherein:

$PkHt_{379(FS)}$ represents the peak height of a fiber sample at 379 $cm^{-1}$;

$PkHt_{379(FS)}$ represents the peak height of a fiber sample at 349 $cm^{-1}$;

$PkHt_{379(CS)}$ represents the peak height of a control sample at 379 $cm^{-1}$;

and $PkHt_{379(CS)}$ represents the peak height of a control sample at 349 $cm^{-1}$.

The equation used for calculation of the percentage of cellulose II present in a cellulose fiber sample is:

$$\text{Cellulose II (weight percent)} = 100\% - \text{Cellulose I (weight percent)}$$

As indicated by the equation for the calculation of the cellulose I, a control sample is used. For a treated cellulose fiber sample, the control sample used is an untreated sample of the same cellulose fiber which is assumed to be 100 weight percent cellulose I.

Wet Curl of Fibers

The Wet Curl value for fibers was determined by using an instrument which rapidly, accurately, and automatically determines the quality of fibers, the instrument being available from OpTest Equipment Inc., Hawkesbury, Ontario, Canada, under the designation Fiber Quality Analyzer, OpTest Product Code DA93.

A sample of never-dried, alkali-metal-hydroxide-treated cellulosic fibers was obtained. The cellulosic fiber sample was poured into a 600 milliliter plastic sample beaker to be used in the Fiber Quality Analyzer. The fiber sample in the beaker was diluted with tap water until the fiber concentration in the beaker was about 10 to about 25 fibers per second for evaluation by the Fiber Quality Analyzer.

An empty plastic sample beaker was filled with tap water and placed in the Fiber Quality Analyzer test chamber. The <System Check> button of the Fiber Quality Analyzer was then pushed. If the plastic sample beaker filled with tap water was properly placed in the test chamber, the <OK> button of the Fiber Quality Analyzer was then pushed. The Fiber Quality Analyzer then performs a self-test. If a warning was not displayed on the screen after the self-test, the machine was ready to test the fiber sample.

The plastic sample beaker filled with tap water was removed from the test chamber and replaced with the fiber sample beaker. The <Measure> button of the Fiber Quality Analyzer was then pushed. The <New Measurement> button of the Fiber Quality Analyzer was then pushed. An identification of the fiber sample was then typed into the Fiber Quality Analyzer. The <OK> button of the Fiber Quality Analyzer was then pushed. The <Options> button of the Fiber Quality Analyzer was then pushed. The fiber count was set at 4,000. The parameters of scaling of a graph to be printed out may be set automatically or to desired values. The <Previous> button of the Fiber Quality Analyzer was then pushed. The <Start> button of the Fiber Quality Analyzer was then pushed. If the fiber sample beaker was properly placed in the test chamber, the <OK> button of the Fiber Quality Analyzer was then pushed. The Fiber Quality Analyzer then began testing and displayed the fibers passing through the flow cell. The Fiber Quality Analyzer also displayed the fiber frequency passing through the flow cell, which should be about 10 to about 25 fibers per second. If the fiber frequency is outside of this range, the <Stop> button of the Fiber Quality Analyzer should be pushed and the fiber sample should be diluted or have more fibers added to bring the fiber frequency within the desired range. If the fiber frequency is sufficient, the Fiber Quality Analyzer tests the fiber sample until it has reached a count of 4000 fibers at which time the Fiber Quality Analyzer automatically stops. The <Results> button of the Fiber Quality Analyzer was then pushed. The Fiber Quality Analyzer calculates the Wet Curl value of the fiber sample, which prints out by pushing the <Done> button of the Fiber Quality Analyzer.

Preparation of Wet-Laid Handsheet

A 17 inch by 17 inch standard handsheet having a basis weight of about 200 grams per square meter was prepared using a desired fiber sample by using a 16 inch by 16 inch cast bronze wet-laid handsheet former mold, available from Voith Corporation.

A British Disintegrator mixer, available from Testing Machines, Inc., was filled with about 2 liters of distilled water at room temperature (about 23° C.) and about 37.3 grams of the fiber sample. The counter on the British Disintegrator was set to zero and the cover was placed on the British Disintegrator. The British Disintegrator was turned on until the counter runs to about 600. Alternatively, the British Disintegrator may be run for about 5 minutes. A bucket was filled with about 8 liters of distilled water. The contents of the British Disintegrator was then also poured into the bucket.

The handsheet former, having an about 12 inch deep chamber, was filled with tap water to about 5 inches below the top of the handsheet former chamber. The contents of the bucket were then poured into the handsheet former chamber. A dedicated stirrer was then used to mix the suspension in the handsheet former chamber. The stirrer was moved slowly up and down 6 times to cause small vortexes, but to avoid causing large vortexes, in the square pattern of the handsheet former. The stirrer was then removed and the suspension was drained through the forming screen of the handsheet former. The handsheet former was then opened and two layers of blotting paper were placed on the top of the handsheet. A roller, having the equivalent of about 2.3 pounds of pressure per linear inch, was moved back and forth once on each of the left side, the right side, and the center of the formed handsheet. The blotting paper, with the formed handsheet attached, was then lifted off the forming screen. The blotting paper was then placed on a table such that the formed handsheet faced upwards. An 18 inch by 18 inch, 4 mesh nylon screen was placed on top of the handsheet. The blotting paper, handsheet, and screen were then flipped so that the screen was on the bottom and the blotting paper was on top. The blotting paper was then peeled off of the handsheet, leaving the handsheet on the screen. The edges of the handsheet were fastened to the screen using binder clips. The handsheet, attached to the screen, was then placed in an oven and dried at about 105° C. for about an hour. The handsheet was then removed from the oven, removed from the screen, and put into a TAPPI conditioning room with conditions of a temperature of about 23° C. and a humidity of about 50 percent for further drying and conditioning overnight. The handsheet was then ready for evaluation for liquid distribution properties.

Bulk and Dry Density of an Absorbent Structure

From a handsheet prepared according to the procedure described herein, a strip of sample handsheet material, having a width of about 2 inches and a length of about 15 inches, was obtained by using a textile saw available, for example from Eastman, Machine Corp., Buffalo, N.Y. The sample strip was cut at least about 1 inch away from the edge of the handsheet so as to avoid edge effects. The sample strip was marked in about 10 millimeter intervals using water-soluble ink.

To measure the bulk of the sample strip, a bulk meter accurate to at least about 0.01 millimeter, such as a bulk meter available from Mitutoyo Corporation, was used. An about one inch diameter platen was used to measure the bulk, with the platen being parallel to the base of the bulk meter. The bulk of the sample strip was measured in about 50 millimeter intervals along the length of the sample strip and then averaged. The average bulk of the sample strip was then used to calculate the dry density of the sample strip, using the weight and dimensions of the sample strip. The wet density of the sample strip may be similarly determined after the sample strip has been evaluated for Vertical Liquid Flux values.

Wicking Time and Vertical Liquid Flux of an Absorbent Structure

From a handsheet prepared according to the procedure described herein, a strip of sample handsheet material, having a width of about 2 inches and a length of about 15 inches, was obtained by using a textile saw available, for example from Eastman, Machine Corp., Buffalo, N.Y. The sample strip was cut at least about 1 inch away from the edge of the handsheet so as to avoid edge effects.

The apparatus used for holding a sample material while measuring the Wicking Time and Vertical Liquid Flux values for the sample material consists of male and female halves. The apparatus had a length of about 21 inches and consists of glued Plexiglas. Small nails are placed in the male bar about one inch apart. The female half has holes drilled to accommodate the nails. A 4 mesh nylon screen was stretched onto the nails. The screen was about one inch shorter than the sample holder at both ends. Reinforcing plates stiffened the bar, preventing the bar from buckling under the tension from the nylon screen. Short, flat, perpendicular bars act as springs to stretch the nylon screen and to keep the sample in place.

The sample strip was placed on the nylon screen, with the bottom end of the sample strip placed lower than the bottom edge of the sample holder such that when the sample strip is positioned on the top of the liquid distribution manifold at the beginning of the experiment, the bottom of the sample strip will just touch the liquid surface. A second 4 mesh nylon screen was stretched and placed on top of the sample strip. Two steel pins were driven through the sample strip at each of 5, 10, 15, and 30 centimeters from the bottom of the sample strip to prevent the movement of the sample strip under the weight of absorbed liquid. The female half of the sample holder was fitted onto the male half. Binder clips were used to keep the assembled holder together.

During the evaluation, the sample strip and the sample holder were contained in a Plexiglas tubular enclosure having an inner diameter of about 7.25 inches and a height of about 24 inches. There is a slit (about 0.25 inch by about 3 inches) in the bottom of the tubular enclosure large enough to allow the tube from the aspirator bottle to the liquid distribution manifold to go through. The tubular enclosure was covered with a flat piece of Plexiglas. Distilled water was sprayed on the walls of the tubular enclosure before the experiment to raise the relative humidity inside the tubular enclosure so as to reduce the evaporation of water from the sample strip during the evaluation. The relative humidity should be maintained at about 90 to about 98 relative humidity during the evaluation. The liquid distribution manifold and the tubular enclosure rest on the top of a Plexiglas plate resting on two lab jacks used for adjustability, stability, and maintaining level.

The aspirator bottle was filled with a 0.9 weight percent sodium chloride aqueous solution. The solution in the aspirator bottle was in equilibrium with the upper edge of the slit in the bottom of the tubular enclosure. The scale was tarred. The sample holder was placed on the top of the liquid distribution manifold. A stopwatch was started as soon as the bottom edge of the sample strip touched the surface of the solution. The cover was placed on the top of the tubular enclosure.

The vertical distance of the liquid front traveling up the sample strip and the liquid weight absorbed by the sample strip at various times was recorded. The time versus liquid front height was plotted to determine the Wicking Time at about 5 centimeters and at about 15 centimeters. The weight of the liquid absorbed by the sample strip from the beginning of the evaluation to about 5 centimeters and to about 15 centimeters height was also determined from the data. The Vertical Liquid Flux value of the sample strip at a particular height was calculated by dividing the grams of liquid absorbed by the sample strip by each of: the basis weight, in grams per square meter, of the sample strip; the time, in minutes, needed by the liquid to reach the particular height; and the width, in inches, of the sample strip.

EXAMPLES

Example 1

A first mixture was prepared by saturating a cellulosic fiber kraft pulp with water at a temperature between about 20°–25° C. for about 30 minutes and then dewatering the cellulosic fibers by mechanical pressing until the cellulosic fiber consistency in the first mixture was between about 27 weight percent to about 50 weight percent. The first mixture was then placed into a blender fitted with a thermal jacket. The blender was tightly covered and the first mixture was kneaded for about 10 minutes at about 25° C.

As second mixture was then prepared by adding sodium hydroxide, either as a dry powder, a 50 weight percent aqueous sodium hydroxide solution, or a mixture of a dry powder and a 50 weight percent aqueous sodium hydroxide solution, to the irst mixture. The sodium hydroxide was added in a calculated amount so that the concentration of sodium hydroxide in the second mixture was between about 13 weight percent to about 50 weight percent and so that the consistency of the cellulosic fibers in the second mixture was between about 27 weight percent to about 50 weight percent. The second mixture was then blended at a temperature between about 20C. to about 80C. for a time between about 10 minutes to about 60 minutes to ensure substantially uniform mixing of the materials in the second mixture. For some samples, mixing of the second mixture was done at two different combinations of temperature and time. At the end of the mixing, the second mixture was then thoroughly washed with water and neutralized with acetic acid to a pH of about 6 to 7. The treated pulp was dewatered by filtration under vacuum and recovered. The treated cellulosic fibers were then evaluated for Wet Curl values, degree and extent of mercerization, and other characteristics.

The process conditions used for each sample are shown in Table 1. For Samples 1–13, a bleached, northern softwood kraft pulp was used as the starting cellulosic fiber kraft pulp. For Samples 14–18, a bleached, southern softwood kraft pulp was used as the starting cellulosic fiber kraft pulp.

TABLE 1

| Sample No. | First Mixture Cellulosic Fiber Consistency (%) | Second Mixture Cellulosic Fiber Consistency (%) | Second Mixture NaOH Concentration (%) | Second Mixture Blending Conditions (Temp/Time) | Wet Curl Value |
|---|---|---|---|---|---|
| 1 | 27.2 | 27.2 | 19 | 22° C./60 min | 0.315 |
| 2 | 27.2 | 27.2 | 17 | 22° C./60 min | 0.301 |
| 3 | 27.2 | 27.2 | 15 | 22° C./60 min | 0.298 |
| 4 | 27.2 | 27.2 | 13 | 22° C./60 min | 0.292 |
| 5 | 27.2 | 27.2 | 17 | 60° C./24 min | — |
| 6 | 27.2 | 27.2 | 13 | 60° C./24 min | — |
| 7 | 27.9 | 27.9 | 13 | 35° C./15 m + 25° C./20 m | 0.293 |
| 8 | 27.9 | 27.9 | 15 | 35° C./15 m + 25° C./20 m | 0.303 |
| 9 | 27.9 | 27.9 | 15 | 35° C./15 m + 25° C./10 m | 0.312 |
| 10 | 27.9 | 27.9 | 17 | 35° C./15 m + 25° C./20 m | 0.325 |
| 11 | 35 | 28.9 | 19.6 | 25° C./20 min | 0.307 |
| 12 | 42 | 36.1 | 18.2 | 65° C./15 m + 25° C./15 m | 0.297 |
| 13 | 42 | 36.1 | 18.2 | 65° C./15 m | 0.289 |
| 14 | 27.6 | 27.6 | 13 | 35° C./15 m + 25° C./20 m | 0.289 |
| 15 | 27.6 | 27.6 | 15 | 35° C./15 m + 25° C./20 m | 0.311 |
| 16 | 27.6 | 27.6 | 15 | 35° C./15 m + 25° C./10 m | 0.301 |
| 17 | 27.6 | 27.6 | 17 | 35° C./15 m + 25° C./20 m | 0.309 |
| 18 | 35 | 28.9 | 19.6 | 25° C./20 min | 0.299 |

Example 2

A large-scale experimental trial was performed at Kimberly-Clark's pulp mill located at Coosa Pines, Ala. Filtered water was used throughout this trial for dilution rather than normal paper machine white water in order to prevent contamination form the paper mill chemicals. A tie line from a 3.5 weight percent consistency paper mill kraft supply line was made to supply cellulosic fiber pulp, a disintegrated dry lap softwood kraft pulp (available from Alliance Corporation under the designation CR54 southern pine kraft pulp), to an Andritz press. The press provided a cellulosic fiber and water first mixture having a consistency of about 35 weight percent cellulosic fibers at a production rate of about 75 tons per day. The temperature of the dewatered pulp was between about 55° C. to about 65° C. About 15 gallons per minute of an about 50 weight percent aqueous sodium hydroxide solution was added to the first mixture in a Rauma-Repola mixer to prepare a second mixture.

Measurements of the cellulosic fiber consistency were taken before and after the Andritz press. Also, samples were taken after the Rauma-Repola mixer to ensure that sufficient sodium hydroxide was being added to attain mercerization of the cellulosic fibers. Liquid was squeezed out of the sodium hydroxide impregnated mixture with a manual press. The sodium hydroxide concentration in the second mixture was determined by titration of a measured amount (about 2 milliliters) with an appropriate, standardized hydrochloric acid solution. The cellulosic fiber consistency in the second mixture was calculated from the measured consistency of the first mixture and from the amount of the 50 weight percent aqueous sodium hydroxide solution added. This procedure allowed for the calculation of an approximate control value for the sodium hydroxide concentration in the water of the second mixture independent of the flow rates of the sodium hydroxide solution and the first mixture.

The temperature of the second mixture leaving the Rauma-Repola mixer was between about 65° C. to about 70° C. The second mixture was then dropped into a downflow tower where the second mixture was stored for about 20 minutes. Tests on samples taken from the downflow tower indicated that mercerization of the cellulosic fibers had occurred. Water was then added to the second mixture at the bottom of the downflow tower to prepare a third mixture having a cellulosic fiber consistency of about 4.5 weight percent. The third mixture was then pumped into a high-density storage tower, from where the third mixture was sent across a screened decker for reclaimation of the sodium hydroxide. It was estimated that about 60 weight percent of the sodium hydroxide was reclaimed and added to a spent liquor system. The treated cellulosic fiber pulp was then moved through five washing stages of a bleachplant.

The transition pulp was collected separately. Once the bleachplant was free of transition pulp, the treated cellulosic fiber product pulp was placed into a second high-density storage tank for use on a Ross dryer. Various cellulosic fiber blends were made by mixing various amounts of the treated cellulosic fiber product pulp with fully bleached southern pine kraft pulp. The Ross dryer processed without excessive difficulties blends with up to about 40 weight percent treated cellulosic fiber in the product pulp.

About 20 tons of about 50 percent treated cellulosic fiber product pulp was produced. Most of the treated cellulosic fiber product pulp was run across a belt press and filled into containers lined with plastic and put into cold storage. Some of the treated cellulosic fiber product pulp was dewatered with a Black-Clawson double nip thickener followed by a screw press. The treated cellulosic fiber product pulp was then bailed and put into cold storage. Some of the treated cellulosic fiber product pulp was run across a Fourdrinier pulp machine and can dryers, wherein a 100 percent treated cellulosic fiber product pulp was obtained in the form of roll pulp.

The treated cellulosic fiber product was evaluated using the procedures described in the Test Procedures section herein. The treated cellulosic fiber pulp sample exhibited a Wet Curl value of about 0.37, an Alpha Cellulose weight percent of about 93.8 percent, a Degree of Uniformity of Alkali Metal Hydroxide Treatment of 96 percent, and, when prepared as a handsheet, a Vertical Liquid Flux rate at 15 cm of about 0.0032 (g/inch/min./gsm).

A sample of the untreated cellulosic fiber pulp (CR54 southern pine kraft pulp) was evaluated using the procedures described in the Test Procedures section herein. The untreated cellulosic fiber pulp sample exhibited a Wet Curl value of about 0.15, an Alpha Cellulose weight percent of about 86.5 percent, a Degree of Uniformity of Alkali Metal Hydroxide Treatment of 0 percent, and, when prepared as a handsheet, a Vertical Liquid Flux rate at 15 cm of about 0.0012 (g/inch/min./gsm).

Example 3

A first mixture was prepared by dewatering, in a laboratory centrifuge, a disintegrated dry lap softwood kraft pulp (available from Alliance Corporation under the designation CR54 southern pine kraft pulp) to a first mixture having a consistency of about 40 weight percent cellulosic fibers. Additional first mixtures having consistencies of about 66 and about 86 weight percent cellulosic fibers were prepared by air drying a 40 weight percent cellulosic fiber mixture at a temperature of about 25° C. for the appropriate amount of time. Additional first mixtures having consistencies of about 20 weight percent cellulosic fibers were prepared by spraying a calculated amount of water to a 40 weight percent cellulosic fiber mixture. Each of the prepared first mixture samples were placed into a plastic bag for conditioning and stored overnight. Each first mixture was then placed into a mixer, available from Jaygo Manufacturing, Inc., under the designation Sigma Mixer. The mixer was fitted with a thermal jacket for temperature adjustment and with two horizontal helixes bars.

A second mixture was then prepared by adding sodium hydroxide, either as a 50 weight percent aqueous sodium hydroxide solution or a mixture of water and a 50 weight percent aqueous sodium hydroxide solution, to a first mixture while the first mixture was being kneaded in the mixer. The second mixture was then mixed at a temperature between about 22°–25° C. and for about 30 minutes so as to prepare a essentially homogeneous second mixture and also to allow for effective chemical and mechanical treatment of the cellulosic fibers. The essentially homogeneous second mixture was then thoroughly washed with water and neutralized with acetic acid such that the essentially homogeneous second mixture exhibited a pH of between about 6 to 7. The essentially homogeneous second mixture was then dewatered by filtration under vacuum.

The amounts, consistencies, and concentrations of the materials used to prepare each sample, as well as the yield achieved in preparing each sample, are shown in Table 2.

The recovered treated cellulosic fibers were then evaluated for Wet Curl values, Alpha Cellulose values, Cellulose II values, and other characteristics using the procedures described in the Test Procedures section herein. The results of these evaluations are shown in Tables 3–6. Sample 37 is an untreated sample of the dry lap softwood kraft pulp.

TABLE 2

| Sample No. | Dry Cellulosic Fibers in First Mixture (g) | Water in First Mixture (g) | First Mixture Fiber Consistency (%) | 50% NaOH Solution added to First Mixture (g) | Addditional Water added to First Mixture (g) | Concentration of NaOH in Second Mixture (%) | Second Mixture Fiber Consistency (%) | Ratio of NaOH to Fiber in Second Mixture (g/g) | Yield of Recovered Treated Fibers (%) |
|---|---|---|---|---|---|---|---|---|---|
| 19 | 66.22 | 10.78 | 86 | 4 | 9 | 8.4 | 75.3 | 0.0302 | 98.2 |
| 20 | 66.22 | 10.78 | 86 | 8 | 4 | 17.6 | 77.9 | 0.0604 | 98.7 |
| 21 | 66.22 | 10.78 | 86 | 13 | 0 | 27.3 | 79.3 | 0.0982 | 100 |
| *22 | 66.22 | 10.78 | 86 | 0 | 10 | 0 | 76.11 | 0 | 100 |
| 23 | 66 | 34 | 66 | 13 | 0 | 13.8 | 62 | 0.0985 | 98.2 |
| 24 | 66 | 34 | 66 | 20 | 0 | 18.5 | 60 | 0.1515 | 99.6 |
| 25 | 66 | 34 | 66 | 8 | 0 | 9.5 | 63.5 | 0.0606 | 97.3 |
| 26 | 66 | 34 | 66 | 5 | 0 | 6.4 | 64.4 | 0.0379 | 100 |
| *27 | 66 | 34 | 66 | 0 | 13 | 0 | 58.4 | 0 | 100 |
| 28 | 66 | 99 | 40 | 50 | 0 | 16.7 | 34.7 | 0.3788 | 89.5 |
| 29 | 66 | 99 | 40 | 20 | 0 | 8.4 | 37.7 | 0.1515 | 98.2 |
| 30 | 66 | 99 | 40 | 70 | 0 | 20.7 | 33 | 0.5303 | 91.5 |
| 31 | 66 | 99 | 40 | 35 | 0 | 13.1 | 36 | 0.2652 | 93.7 |
| *32 | 66 | 99 | 40 | 0 | 35 | 0 | 33 | 0 | 100 |
| *33 | 60 | 240 | 20 | 45 | 0 | 7.9 | 18.6 | 0.375 | 94 |
| *34 | 60 | 240 | 20 | 90 | 0 | 13.6 | 17.4 | 0.75 | 86.9 |
| *35 | 60 | 240 | 20 | 135 | 0 | 18 | 16.3 | 1.125 | 92.4 |
| *36 | 60 | 240 | 20 | 0 | 60 | 0 | 16.7 | 0 | 100 |

*Not an example of the present invention

TABLE 3

| Sample No. | Alpha Cellulose Content (Weight %) | Cellulose II Content (%) | Wet Curl Value | Density (g/cc) | Vertical Liquid Flux at 15 cm ($10^{-4}$ g/inch/min./gsm) |
|---|---|---|---|---|---|
| 19 | 87.3 | 0 | 0.283 | 0.207 | 18 |
| 20 | 88.4 | 0 | 0.273 | 0.197 | 20 |
| 21 | 88.7 | 0 | 0.275 | 0.192 | 21 |
| *22 | — | — | — | 0.217 | 17 |
| 23 | 90 | 25.7 | 0.284 | 0.174 | 25 |
| 24 | 88.3 | 0 | 0.289 | 0.193 | 24 |
| 25 | 89.8 | 38.7 | 0.273 | 0.186 | 27 |
| 26 | 88.1 | 15.4 | 0.266 | 0.203 | 21 |
| *27 | — | — | — | 0.228 | 16 |
| 28 | 92.5 | 47.4 | 0.299 | 0.157 | 35 |
| 29 | 89.6 | 0 | 0.283 | 0.251 | 21 |
| 30 | 93.4 | 56.9 | 0.294 | 0.15 | 33 |
| 31 | 91.7 | 29.4 | 0.273 | 0.177 | 32 |
| *32 | — | — | 0.296 | 0.239 | 10 |
| *33 | 92.3 | 0 | 0.321 | 0.197 | 20 |
| *34 | 95.4 | 45 | 0.325 | 0.159 | 31 |
| *35 | 96 | 57.6 | 0.323 | 0.153 | 36 |
| *36 | 87.5 | 0 | 0.231 | 0.25 | 8 |
| *37 | — | — | 0.197 | 0.251 | 9 |

*Not an example of the present invention

TABLE 4

Effect of Sodium Hydroxide Concentration on Vertical Liquid Flux Value (*10^-4 g/inch min. gsm)

| Second Mixture Cellulosic Fiber | Approximate Concentration of Sodium Hydroxide in Second Mixture (%) | | | |
|---|---|---|---|---|
| Consistency (%) | 0 | 8 | 13 | 18 |
| *20 | 8 | 20 | 31 | 36 |
| 40 | 10 | 20.5 | 32 | 34 |
| 66 | 15.5 | 23.8 | 24.5 | 24 |
| 86 | 17 | 18 | — | 20 |

*Not an example of the present invention

TABLE 5

Effect of Sodium Hydroxide Concentration on Amount of Sodium Hydroxide Application per gram of Cellulosic Fiber (g. NaOH/g. Cellulosic Fiber)

| Second Mixture Cellulosic Fiber | Approximate Concentration of Sodium Hydroxide in Second Mixture (%) | | | |
|---|---|---|---|---|
| Consistency (%) | 0 | 8 | 13 | 18 |
| *20 | 0 | 0.375 | 0.75 | 1.125 |
| 40 | 0 | 0.15 | 0.27 | 0.38 |
| 66 | 0 | 0.05 | 0.1 | 0.15 |
| 86 | 0 | 0.032 | — | 0.06 |

*Not an example of the present invention

TABLE 6

Effect of Sodium Hydroxide Concentration on Wet Curl Value

| Second Mixture Cellulosic Fiber | Approximate Concentration of Sodium Hydroxide in Second Mixture (%) | | | |
|---|---|---|---|---|
| Consistency (%) | 0 | 8 | 13 | 18 |
| *20 | 0.231 | 0.321 | 0.325 | 0.323 |
| 40 | 0.296 | 0.273 | 0.296 | 0.286 |

TABLE 6-continued

Effect of Sodium Hydroxide Concentration on Wet Curl Value

| Second Mixture Cellulosic Fiber | Approximate Concentration of Sodium Hydroxide in Second Mixture (%) | | | |
|---|---|---|---|---|
| Consistency (%) | 0 | 8 | 13 | 18 |
| 66 | 0.29 | 0.27 | 0.284 | 0.289 |
| 86 | — | 0.283 | 0.286 | 0.273 |

*Not an example of the present invention

Those skilled in the art will recognize that the present invention is capable of many modifications and variations without departing from the scope thereof. Accordingly, the detailed description and examples set forth above are meant to be illustrative only and are not intended to limit, in any manner, the scope of the invention as set forth in the appended claims.

What is claimed is:

1. A process for the treatment of cellulosic fibers comprising:

a) preparing a first mixture comprising a weight amount of cellulosic fibers and a weight amount of water, wherein the cellulosic fibers are present at a consistency of between 27 to about 100 weight percent based upon the total weight amount of cellulosic fibers and water present in the first mixture, b) preparing a second mixture by adding a weight amount of alkali metal hydroxide to the first mixture, wherein the alkali metal hydroxide is present in the second mixture at a concentration of between about 5 to about 55 weight percent based upon the total weight amount of alkali metal hydroxide and water present in the second mixture, and the cellulosic fibers are present in the second mixture at a consistency of between 27 to about 90 weight percent based upon the total weight amount of cellulosic fibers and water present in the second mixture;

c) treating the second mixture under conditions effective for the second mixture to form an essentially homogeneous second mixture;

d) treating the essentially homogeneous second mixture under conditions effective for the treated cellulosic fibers to exhibit a Wet Curl value that is greater than about 0.25; and e) recovering the treated cellulosic fibers.

2. The process of claim 1 wherein the cellulosic fibers are from a wood source.

3. The process of claim 1 wherein the essentially homogeneous second mixture is treated with a high-energy refining process.

4. The process of claim 1 further comprising forming the first mixture into an essentially homogeneous first mixture.

5. The process of claim 1 wherein the alkali metal hydroxide is sodium hydroxide, potassium hydroxide, or lithium hydroxide.

6. The process of claim 1 wherein the alkali metal hydroxide is sodium hydroxide.

7. The process of claim 1 wherein the alkali metal hydroxide is present in the second mixture at a concentration of between about 8 to about 50 weight percent based upon the total weight amount of alkali metal hydroxide and water present in the second mixture.

8. The process of claim 1 wherein the cellulosic fibers are present in the second mixture at a consistency of between 30 to about 90 weight percent based upon the total weight amount of cellulosic fibers and water present in the second mixture.

9. The process of claim 1 wherein the cellulosic fibers are present in the second mixture at a consistency of between about 35 to about 90 weight percent based upon the total weight amount of cellulosic fibers and water present in the second mixture.

10. The process of claim 1 wherein the essentially homogeneous second mixture is treated under conditions that comprise a temperature that is between about −20° C. to about 100° C.

11. The process of claim 10 wherein the essentially homogeneous second mixture is treated under conditions that comprise a temperature that is between about 50° C. to about 100° C.

12. The process of claim 1 further comprising washing the treated cellulosic fibers.

13. The process of claim 12 wherein the treated cellulosic fibers are washed at a temperature between about 50° C. to about 90° C.

14. The process of claim 1 wherein the treated cellulosic fibers exhibit a Wet Curl value that is between about 0.25 to about 0.6.

15. A process for the treatment of cellulosic fibers comprising:

a) preparing a first mixture comprising a weight amount of cellulosic fibers and a weight amount of water, wherein the cellulosic fibers are present at a consistency of between 27 to about 100 weight percent based upon the total weight amount of cellulosic fibers and water present in the first mixture, b) preparing a second mixture by adding a weight amount of alkali metal hydroxide to the first mixture, wherein the alkali metal hydroxide is present in the second mixture at a concentration of between about 5 to about 55 weight percent based upon the total weight amount of alkali metal hydroxide and water present in the second mixture, and the cellulosic fibers are present in the second mixture at a consistency of between 27 to about 90 weight percent based upon the total weight amount of cellulosic fibers and water present in the second mixture;

c) treating the second mixture under conditions effective for the second mixture to form an essentially homogeneous second mixture;

d) treating the essentially homogeneous second mixture under conditions effective for the treated cellulosic fibers to be mercerized; and e) recovering the treated cellulosic fibers.

16. The process of claim 15 wherein the mercerized cellulosic fibers exhibit a degree of mercerization that is greater than about 75 percent.

17. A process for the treatment of cellulosic fibers comprising:

a) preparing a first mixture comprising a weight amount of cellulosic fibers and a weight amount of water, wherein the cellulosic fibers are present at a consistency of between 27 to about 100 weight percent based upon the total weight amount of cellulosic fibers and water present in the first mixture, b) preparing a second mixture by adding a weight amount of alkali metal hydroxide to the first mixture, wherein the alkali metal hydroxide is present in the second mixture at a concentration of between about 5 to about 55 weight percent based upon the total weight amount of alkali metal hydroxide and water present in the second mixture, the cellulosic fibers are present in the second mixture at a consistency of between 27 to about 90 weight percent based upon the total weight amount of cellulosic fibers and water present in the second mixture, there is a ratio of the weight amount of water to the weight amount of cellulosic fibers, and the cellulosic fibers exhibit a degree of cellulosic fiber swelling;

c) treating the second mixture under conditions effective for the second mixture to form an essentially homogeneous second mixture, wherein the weight ratio of the water to the cellulosic fibers in the essentially homogeneous second mixture is not less than the saturated weight ratio of water to the cellulosic fibers based on the degree of swelling of the cellulosic fibers in an equilibrium state;

d) treating the essentially homogeneous second mixture under conditions effective for the treated cellulosic fibers to exhibit a Wet Curl value that is greater than about 0.25; and e) recovering the treated cellulosic fibers.

* * * * *